United States Patent [19]

Mizuno

[11] Patent Number: 4,491,988

[45] Date of Patent: Jan. 8, 1985

[54] IN-TANK TOILET BOWL CLEANER DISPENSER

[75] Inventor: William G. Mizuno, Saint Paul, Minn.

[73] Assignee: Economics Laboratory, Inc., St. Paul, Minn.

[21] Appl. No.: 461,968

[22] Filed: Jan. 28, 1983

[51] Int. Cl.[3] ..... E03D 9/02

[52] U.S. Cl. ..... 4/228; 4/227; 222/185

[58] Field of Search ..... 4/228, 227, 222; 222/185

[56] References Cited

U.S. PATENT DOCUMENTS

| | | | |
|---|---|---|---|
| 2,736,039 | 2/1956 | Majo | 4/227 |
| 2,913,734 | 11/1959 | O'Hare | 4/227 |
| 2,967,310 | 1/1961 | O'Hare | 4/227 |
| 3,768,104 | 10/1973 | Sanderson | 4/228 |
| 3,781,926 | 1/1974 | Levey | 4/228 |
| 3,831,205 | 8/1974 | Foley | 4/228 |
| 4,171,546 | 10/1979 | Dirksing | 4/228 |
| 4,186,856 | 2/1980 | Dirksing | 222/424 |
| 4,208,747 | 1/1980 | Dirksing | 4/228 |
| 4,209,864 | 7/1980 | Lindauer | 4/228 |
| 4,216,027 | 8/1980 | Wages | 134/36 |
| 4,302,350 | 11/1981 | Callicott | 252/174 |
| 4,305,162 | 12/1981 | Cornelisse | 4/228 |
| 4,307,474 | 12/1981 | Choy | 4/228 |
| 4,308,625 | 1/1982 | Kitko | 4/228 |
| 4,357,718 | 11/1982 | Corsette | 4/228 |
| 4,375,109 | 3/1983 | Jones | 4/227 X |

FOREIGN PATENT DOCUMENTS

| | | | |
|---|---|---|---|
| 228564 | 6/1960 | Australia | 4/228 |
| 24302 | of 1910 | United Kingdom | 4/228 |

*Primary Examiner*—Henry K. Artis

*Attorney, Agent, or Firm*—Merchant, Gould, Smith, Edell, Welter and Schmidt

[57] ABSTRACT

A dispenser (10) for use in a flush tank of a toilet is disclosed. The flush tank has a first water level (17) during quiescent periods and a second water level (18) when the toilet is flushed. The dispenser (10) includes a housing (11) having a top (11*a*) and bottom (11*b*). The housing (11) defines a reservoir (12) having an inlet (13) proximate the top (11*a*) and an outlet (14) positioned lower than the inlet (13). The reservoir (12) holds the product to be dispensed, the product dissolving in water and forms a solution. A first valve means (16) for regulating flow of water from the flush tank into the reservoir (12) through the inlet (13) is provided. The first valve means (16) is responsive to changes from the first water level (17) to the second water level (18). The second valve means (24) regulates flow of solution out of the reservoir (12) through the outlet (14). The second valve means (24) is also responsive to changes from the first water level (17) to the second water level (18), whereby when the water rises to its first water level (17), the second valve means (24) is closed. Water enters the reservoir (12) through the inlet (13) until the reservoir (12) is filled causing the first valve means (16) to close. The first valve means (16) and second valve means (24) minimize migration of the solution out of the reservoir (12) during quiescent periods. When the water is at the second water level (18), the second valve means (24) opens and allows the solution to flow out of the outlet 14.

15 Claims, 14 Drawing Figures

FIG. 1
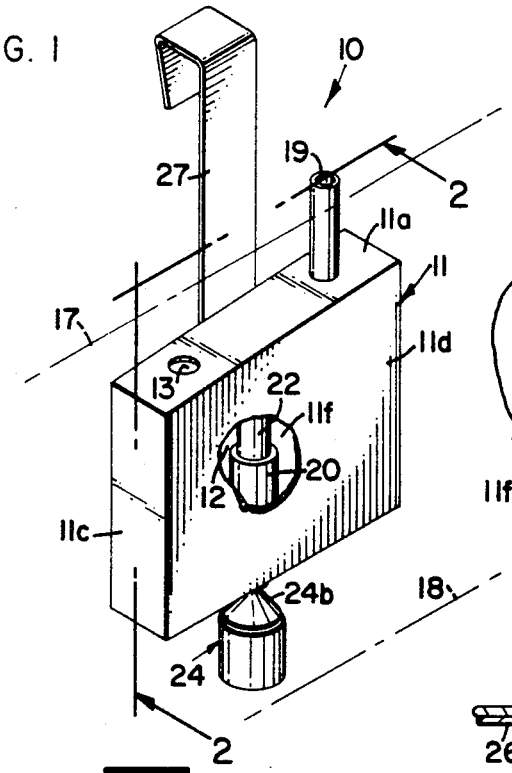
FIG. 3
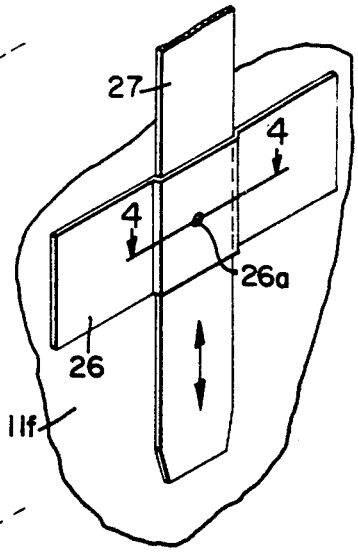
FIG. 4
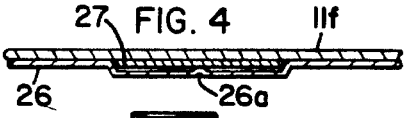
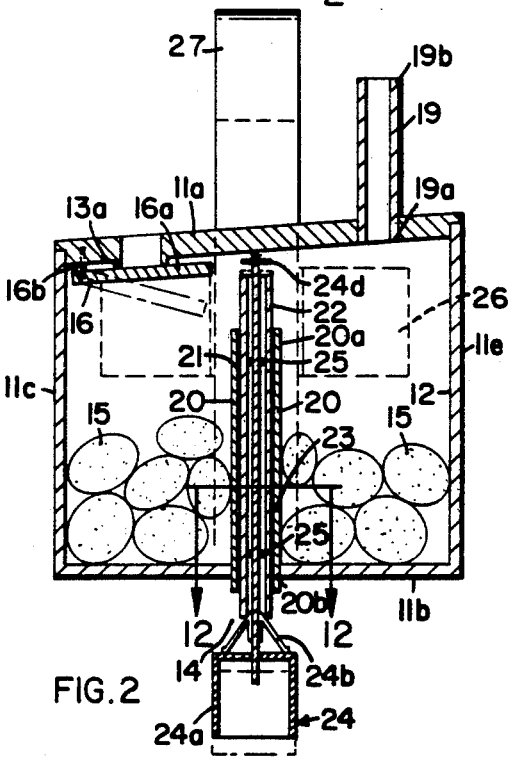
FIG. 2
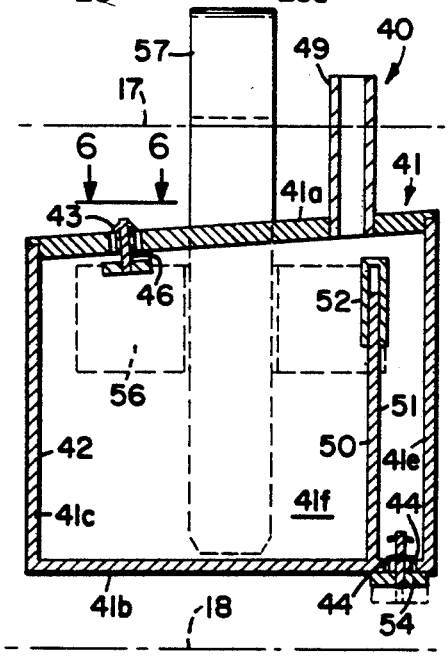
FIG. 5

FIG. 13
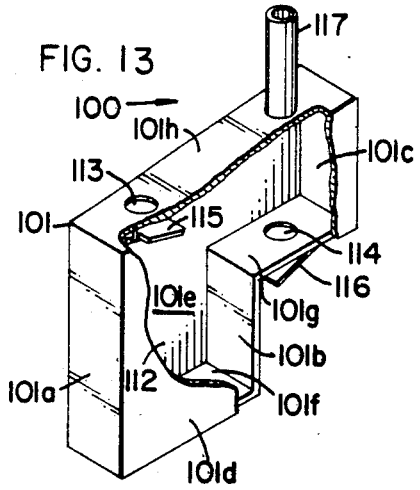
FIG. 12
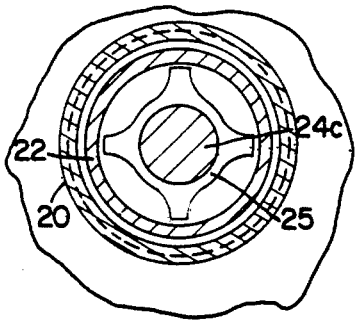
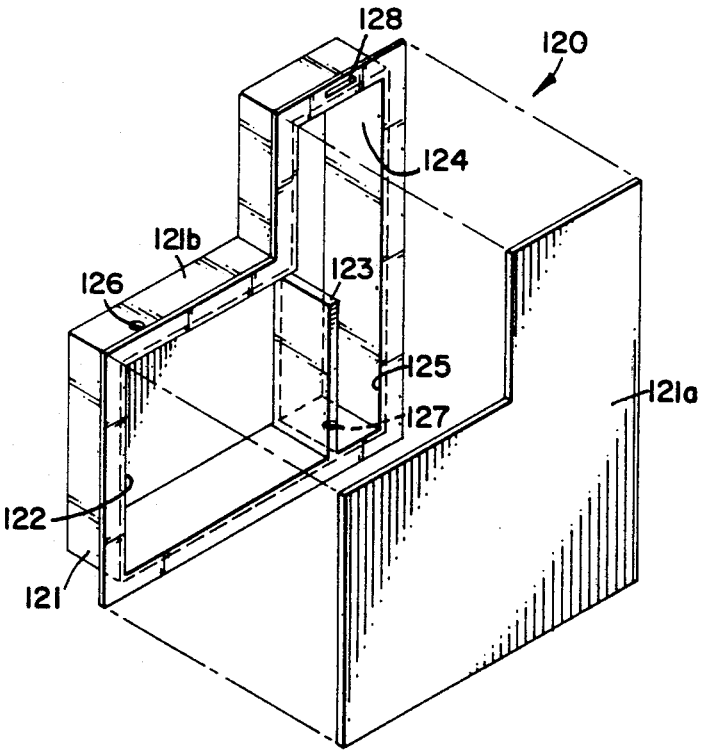
FIG. 14

IN-TANK TOILET BOWL CLEANER DISPENSER

BACKGROUND OF THE INVENTION

1. Field of the Invention

The present invention relates generally to an in-tank dispenser and more particularly to a dispenser in which a solid product or products contained within the dispenser are dissolved in a reservoir containing water, thereby forming a solution and a measured amount of the solution is released as water in the toilet tank recedes when the flush valve is operated.

2. Description of the Prior Art

Prior art means for treating toilet tank water include a solid cake of product being placed at the bottom of the toilet tank. The solid cake would slowly dissolve and migrate into the tank water by diffusion. Another prior art device provides an enclosure and a reservoir for slowly dissolving a solid cake. The enclosure has openings that discharge the solution when the toilet is flushed and refilled when the water tank is refilled. This dispenser is generally located at the bottom of the tank and weighted down by a container weight or by placing gravel within the container. A major disadvantage of this type of dispenser is that there is migration or diffusion of the product into the tank water during long quiescent periods thereby resulting in over-dispensing.

Another prior art dispenser provides for dispensing a liquid concentrate into the tank water. A flow actuated mechanism releases the liquid concentrate from a liquid reservoir when the water level in the toilet tank drops and reseals the reservoir when the water level forces the float against a seal. While this dispenser works well for solutions of low surface tension, it is inoperative when surface tension is near that of water, or approximately 73 dynes per centimeter. Accordingly, this dispenser will not dispense liquid chlorine such as sodium hypochlorite unless a surface tension reducing agent is added. Sodium hypochlorite is a strong oxidizing agent and organic surfactants or other organic treatment materials have limited compatibility with a resulting loss in available chlorine or surfactant activity.

More recently, a passive dosing dispenser has been used in toilet tanks. The passive dosing dispenser includes a trapped air bubble to provide an air lock to isolate the product in the dispenser from the water in the tank.

SUMMARY OF THE INVENTION

The present invention provides a dispenser for use in a flush tank of a toilet. The flush tank has a first water level during quiescent periods and a second water level when the toilet is flushed. The dispenser includes a housing having a top and bottom. The housing defines a reservoir having an inlet proximate the top and an outlet positioned lower than the inlet. The reservoir holds a product to be dispensed. The product dissolves in water and forms a solution. A first valve means is provided for regulating flow of water from the flush tank into the reservoir through the inlet. The first valve means is responsive to changes from the second water level to the first water level. A second valve means is provided for regulating flow of the solution out of the reservoir through the outlet. When the water is at the second water level, the second valve means opens and allows the solution to flow out of the outlet. The second valve means is responsive to changes from the second water level to the first water level, whereby when the water rises to its first water level, the second valve means is closed and water enters the reservoir through the inlet until the reservoir is filled, causing the first valve means to close. The first and second valve means minimize migration of the solution out of the reservoir.

In a preferred embodiment, the dispenser also includes an upwardly extending wall means cooperatively connected to the housing. The wall means defines a cavity having an open top end and an open bottom. The bottom is positioned over the outlet and the open top end is in fluid communication with the reservoir. Only the solution that is in the cavity and in the reservoir that is above the point where the cavity is in fluid communication with the reservoir flows out of the outlet. Further, the wall means is adjustable in height to provide for a variable amount of solution that will be dispensed with each flush of the toilet.

BRIEF DESCRIPTION OF THE DRAWINGS

FIG. 1 is a view in perspective of the dispenser of the present invention;

FIG. 2 is a cross-sectional view of the dispenser illustrated in FIG. 1, taken generally along the lines 2—2;

FIG. 3 is an enlarged perspective view of a portion of the dispenser illustrated in FIG. 1;

FIG. 4 is a cross-sectional view of the dispenser shown in FIG. 3, taken generally along the lines 4—4;

FIG. 5 is a cross-sectional view of another embodiment of the present invention;

FIG. 12 is a cross-sectional view of the dispenser of FIG. 2, taken generally along the lines 12—12;

FIG. 13 is a view in perspective of still another embodiment of the present invention;

FIG. 14 is an exploded perspective view of still another embodiment of the present invention.

DETAILED DESCRIPTION OF THE PREFERRED EMBODIMENT

Figure 6:
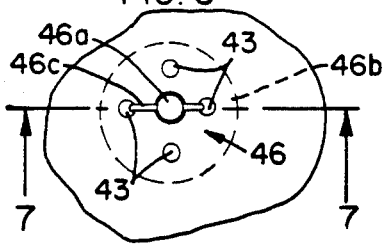
FIG. 6 is a cross-sectional view of the dispenser in FIG. 5, taken generally along the lines 6—6.

Referring to the Drawing, wherein like numerals represent like parts throughout the several views, an in-tank toilet bowl cleaner dispenser designated generally at 10 is shown in FIGS. 1 through 4. A housing 11 has sidewalls 11*c*, 11*d*, 11*e*, and 11*f* cooperatively connected to a top 11*a* and a bottom 11*b* to form a liquid-tight housing. The housing defines an interior reservoir 12. The housing 11 has an inlet 13 formed in the top 11*a* and an outlet 14 formed in the bottom 11*b*. The product 15 to be dispensed may be any suitable agent including detergents, water conditioners, dyes, perfume, surfactants, or scale inhibitors. The product may take the shape of either the solid, gel, or powder. Water that enters the reservoir 12 dissolves a portion of the product 15 forming a solution to be dispensed. A hinged flap valve 16 is cooperatively connected to the top 11*a* and regulates the flow of water from the flush tank into the reservoir 12 through the inlet 13. The valve 16 includes two L-shaped wire hinged members, only one being shown in the cross-section in FIG. 2. Each L-shaped hinge member 16*b* has a first end cooperatively connected to the top 11*a* and a second end cooperatively connected to float portion 16*a*. The hinges 16*b* and float 16*a* form the valve 16 that is responsive to changes to the level of water in the flush tank, as will be more fully described hereinafter. The float portion 16*a* may be made of any material that is less dense than water and will not become water logged. A closed cell foam material, such as a closed cell polyethlene foam with a smooth skin is preferred. It is understood that the flap 16 may be replaced by other suitable valve systems, such as a ball check valve, umbrella valve, or any suitable valve. In FIG. 2, the solid line indicates the valve 16 in a closed position and the dashed line indicates the valve 16 in an open position. The inlet 13 has a lip 13*a*. The float portion 16*a* floats upward with the rise of water in the reservoir 12 and seals the inlet 13.

When the dispenser 10 is placed in a flush tank, the flush tank will have a first water level, indicated by the dashed line 17 during quiescent periods and a second water level, indicated by the dashed line 18 when the toilet is flushed. An air vent 19 is cooperatively connected to the top 11*a* and has a first end 19*a* in fluid communication with the reservoir 12 and a second end 19*b* that will extend above the first water level 17 and be open to the atmosphere.

A standpipe 20, or outer tubing, is cooperatively connected to the bottom 11*b*. The standpipe 20 has an open top end 20*a* and an open bottom end 20*b* positioned over the outlet 14. The standpipe 20 makes a liquid-tight seal with the bottom 11*b* of the housing 11. The standpipe 20 defines an internal cavity 21. An inner tube 22 of a smaller diameter than the standpipe 20 fits snuggly into the standpipe 20. The standpipe 20 has an indentation 20*c* to which an O-ring 23 is cooperatively connected. The O-ring 23 provides a fluid-tight seal between the standpipe 20 and inner tube 22. The inner tube 22 may be slid up and down within the standpipe 20, thereby effectively lengthing or shortening the standpipe 20, thereby decreasing or increasing the amount of solution dispensed, as will be more fully described hereinafter.

A float valve assembly 24 regulates the flow of solution out of the reservoir 12 through the outlet 14. The float valve assembly 24 is responsive to changes from the first water level 17 to the second water level 18, as will be more fully described hereinafter. The float valve assembly 24 includes a float 24*a* in the general shape of a cylinder having an open bottom. A conical top portion 24*b* is cooperatively connected to the float 24*a*. A stem 24*c* is cooperatively connected to the conical top 24*b* and extends inside the inner tube 22. A pin 24*d* is cooperatively connected to the stem 24*c* and rests on the inner tube 22 when the float assembly 24 is in an open position. The open position is shown in FIG. 2 by the dashed lines and the closed float position is shown by the solid lines. Spacers 25 are positioned around and cooperatively connected to the stem 24*c*. The spacers 25 act as a bearing to keep the stem 24*c* in alignment as the float valve assembly travels up and down. The spacers are smaller than the inner diameter of the inner tube 22 and provide for a passageway of solution as the solution leaves the reservoir 12 through the inner tube 22 to the outlet 14. It is to be understood that this float valve assembly including the float, the conical top, stem, spacer and pin may be molded in one piece from a resilient material such as polyethylene, the pin behaving as a toggle.

A bracket 26 is cooperatively connected to the sidewall 11*f*. The bracket has a protrusion which forms a slot to receive a hanger 27. The hanger 27 has a hook at a top end which is slid over a wall of the tank. The hanger 26 is slideable within the slot of the bracket 26, thereby the depth to which the dispenser 10 is immersed in the flush tank may be controlled. The bracket 26 has a protrusion 26*a* to cause a tighter friction fit between the bracket 26 and hanger 27.

The top 11*a* of the housing 11 may be removable so that the product 15 may be inserted in the reservoir 12. The product 15 is normally filled to a level below the level of the standpipe 20 so that there is some reservoir of solution of dissolved solid products when the dispenser 10 has released a premeasured amount of solution from the dispenser. This insures that there will be solution to be released when the toilet is flushed successively without a long quiescent period in between flushes.

In a preferred embodiment, the top 11*a* has one end relatively higher than its other end. The air vent 19 is cooperatively connected to the higher end. This insures that any entrapped air in the reservoir 12 will be at a minimum. Alternatively the top may be gabled with the air vent located at its apex. The vent may maintain atmospheric pressure in the reservoir independent of the first valve means although the weight of the valve will cause it to drop in elevation.

Figure 7:
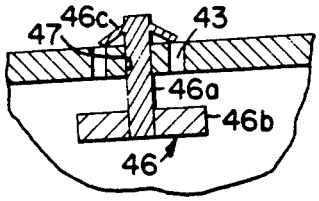
FIG. 7 is a cross-sectional view of the dispenser illustrated in FIG. 6, taken generally along the lines 7—7.

Another embodiment of the present invention is shown in FIG. 5, and the dispenser is generally designated at 40. The dispenser 40 includes a housing 41 having a top 41*a*, bottom 41*b*, both cooperatively connected by sidewalls 41*c*, 41*e* and 41*f*, to form a liquid-tight dispenser. The sidewall which would correspond to sidewall 11*d* is not shown, but completes the housing 41. The liquid-tight dispenser 42 defines a reservoir 42 having an inlet 43 and outlet 44. An inlet valve 46 regulates the flow of water through the inlet 13 to the reservoir 42. The valve 46 has a stem 46*a* to which a float portion 46*b* is cooperatively connected. The stem 46*a* has molded pins 46*c* at the opposite end to which the float 46*b* is attached. The float 46*b* is of a material similar to that of the float 16*a*. The stem 46*a* is inserted through a hole 47 in the top 41*a*. As the stem is forced through the hole 47, the pins 46*c* are compressed along the side of the stem 46*a*. Once the stem 46*a* is inserted far enough into the hole 47, the pins 46*c* will be free to spring back in the outward position, as shown in FIG. 7, to secure the valve 47 to the top 41*a*. When the float 46*b* rises due to water entering the reservoir 42, the float 46*b* will close the inlets 43. An air vent 49 is cooperatively connected to the top 41*a* similar to the vent 19 of the dispenser 10. The outlet 44 is a plurality of small holes that are sealed by a float valve 54 similar to construction to the valve 46. The open position of the valve 46 is shown in dashed lines and the closed position in solid lines in FIG. 5.

A septum 50 is cooperatively connected to the bottom 41*b* and the two sidewalls perpendicular to sidewall 41*e*. The septum 50 and sidewalls define an inner cavity 51 is similar to the inner cavity 21 of dispenser 10. The clip 52 is slideably attached to the septum 50, to effectively increase or decrease the height of the septum 50. A bracket 56 and hanger 57 similar to bracket 26 and hanger 27 is secured to the housing 41 holding the dispenser 40 in position on the flush tank.

Figure 8:
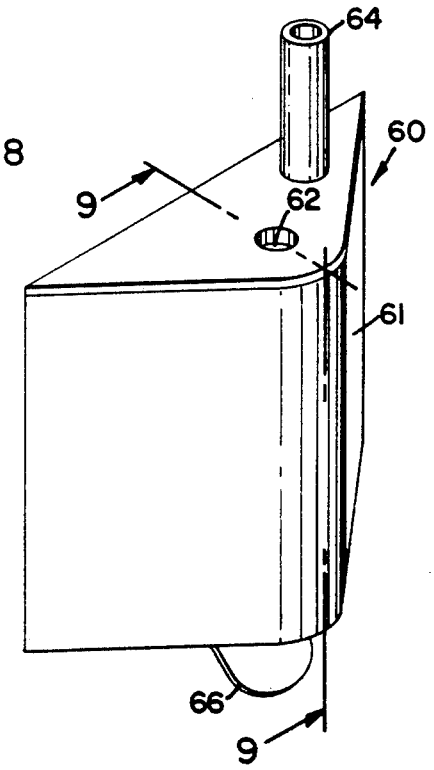
FIG. 8 is a view in perspective illustrating another embodiment of the present invention.
Figure 9:
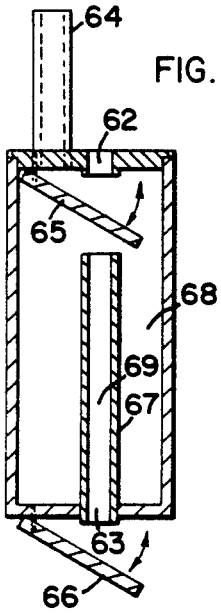
FIG. 9 is a cross-sectional view of the dispenser illustrated in FIG. 8, taken generally along the lines 9—9.
Figure 11:
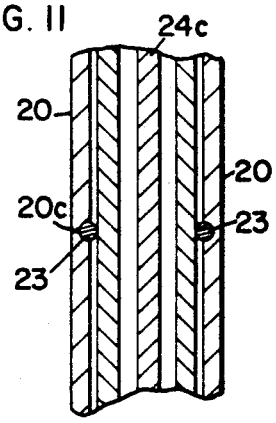
FIG. 11 is an enlarged view of a portion of the dispenser shown in FIG. 2.

Another embodiment of the present invention is shown in FIGS. 8 and 9 and is generally designated as 60. The dispenser 60 has a housing 61 in the general shape of a triangular prismatic shape dispenser. Such a dispenser would fit into the corners of a toilet tank. The dispenser 70 as is its various components, components that are similar to those previously described for dispensers 10 and 40. Dispenser 60 has a housing 61, inlet 62, outlet 63, air vent 64, inlet valve 65, outlet valve 66, standpipe 67, reservoir 68, inner cavity 69.

Figure 10:
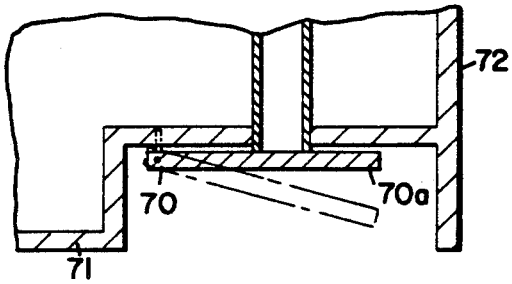
FIG. 10, is a cross-sectional view of a portion of another embodiment of the present invention.

FIG. 10 shows another embodiment of a dispenser having a recessed outlet valve 70. While the entire dispenser is not shown, it is understood that the dispenser may be similar to any of the previously described dispensers. A recess outlet valve 70 would be used to minimize damage during handling or shipping of the dispenser. When the flotation part 70*a* of valve 70 is in the open position, as indicated by the dashed lines in FIG. 10, the bottom 71 of the housing end sidewall 72 of the housing would prevent damage to the flap valve 70.

Still another embodiment of the present invention is shown in FIG. 13 and the dispenser is designated generally as 100. The dispenser 100 has a housing 101 in the general shape of an inverted L-shaped box. Sidewalls 101*a*, 101*b*, and 101*c* are cooperatively connected to the front wall 101*d* and back wall 101*e* and the bottom wall 101*f*, intermediate bottom wall 101*g* and top 101*h* to form a liquid-tight dispenser defining a resevoir 112. The top 101*h* may be removable and forms a liquid-tight seal with the sidewalls. The dispenser 100 has an inlet 113 and an outlet 114 which are similar to the inlets and outlets previously described in the other embodiments. Similarly, an inlet valve (not shown), outlet valve 116 and air vent 117 are likewise similar to the previously described inlet valves, outlet valves and air vents. As can be seen, the intermediate bottom wall 101*g* defines a reservoir 112 that has two different heights. The heights between the bottom wall 101*f* and top 101*h* being greater than the height between the intermediate bottom wall 101*g* and top 101*h*. The advantages of having this height differential will be more fully discussed hereinafter.

The previously described dispensers, 10, 40, 60 and 100 may be constructed by various manufacturing techniques well-known in the art. The previously described dispensers 10, 40, 60 and 100 may be constructed by various manufacturing techniques well-known in the art, one such method of fabrication would be to fabric the housings by injection molding using polyethylene, polypropylene, polyvinyl chloride, Plexiglass, or the like. If a reusable dispenser is desired, the top section of the housing could be constructed with a water-tight snap fit. The dispensers would also be made by vacuum thermal forming or pressure molding using chemically inert material such as polyvinyl chloride for a disposable heat sealed unit for a low cost unit. A chemically inert material such as polyvinyl chloride or polyethylene is especially desireable when a strong oxidizing agent such as a hypohalite yielding material is to be dispensed. Another method, but not as economical as the above mentioned methods would be to fabricate the housings out of rigid Plexiglass® material or the like. The sections of the housing would be adhesively secured to one another except for the top section of the housing which would constructed with a water-tight snap fit. It may be also advantageous to provide the top of the housing with a seal means to further insure a liquid-tight seal. In addition, the dispensers could be constructed at relatively low cost by using high speed manufacturing techniques well-known in the art. One such example would be to use injection molding or vacuum thermal forming using a polyvinyl chloride material.

An embodiment showing a dispenser that has been been vacuum molded, is shown in FIG. 14. The dispenser 120 has a housing 121 having a back portion 121*a* and a formed front portion 121*b*. The formed front 121*b* forms a reservoir 122. Intermediate sidewalls 123 along with the sidewall 124 form an inner cavity 125 similar to the previously described cavities in the other embodiments of this invention. The housing has an inlet 126 and an inlet valve (not shown) similar to the previously described inlets and inlet valves. Likewise, an outlet 127 and an outlet valve means (not shown) is similar to the previously described outlet and outlet valve in the other embodiments of this invention. The back 121*a* of the housing has a slot 128 to receive a hanger that may be used to support the dispenser 120 in the flush tank of a toilet.

In operation of the dispenser 10, the dispenser 10 is inserted into the flush tank of a toilet and is held in position by the hanger 27. During quiescent periods, the water level is at the first water level 17. The water in the flush tank enters the reservoir 12 through the inlet 13. The water enters the inlet 13 due to the differences between the pressure within and without the reservoir 12. As the water rises in the reservoir 12, the float portion 16*a* of the valve 16 begins to rise. The valve 16 closes when the reservoir 12 is filled with water, thereby sealing the solution formed inside the reservoir 12 from the tank water. Any entrapped air that may be in the reservoir 12 is vented through the air vent 19. The sloped top 11*a* insures that any entrapped air is vented through the air vent 19. It is understood that the dispenser 10 could have a straight top and the dispenser could be hung at any angle with the air vent being higher. This would also insure that trapped air would go to the air vent. The outlet float valve assembly 24 is closed because of air entrapment in the float 24*a*. This seals the outlet 14, thereby isolating the solution within the reservoir 12 from the tank water. The valve 16 and float valve 24 minimize or prevent any migration out of the reservoir 12 into the flush tank during quiescent periods. When the toilet is flushed, the water recedes to its second water level 18 which is below the float valve assembly 24. The float valve assembly 24 opens due to the weight of the float valve assembly 24. The travel of the float valve assembly 24 is limited by pin 24*d* which rests on the top of the inner tube 22. The space between the stem 24*d* and the inner tube 22 allows the solution from the reservoir 12 to flow through the inner tube 22 and into the toilet tank and the flush water, thereby filling the toilet bowl water with a solution of the treatment chemical. The stem 24*c* of the float valve assembly 24 has a star shaped spacer 25 which allows the solution flow through the inner tube 22. The water that enters the reservoir 12 dissolves the product 15 forming a solution that is discharged through the outlet 14. The amount of solution that is discharged can be effectively controlled by sliding the inner tube 22 up or down within the standpipe 20. Only the solution that is located above the top end of the inner tube 22 and the amount of solution inside the inner tube 22 is actually discharged. The remaining solution stays within the reservoir 12. Then on successive flushes, additional water is allowed to enter through the inlet 13, thereby bringing the level of fluid in the reservoir 12 to be above the top of the inner tube 22. One of the advantages of not draining all of the solution out of the reservoir 12 is that solution will be available to be released when the toilet is flushed successively without a long quiescent period in between.

The operation of the dispenser 40 is very similar to the operation of dispenser 10. The septum 50 and sidewalls now form the equivalent of the standpipe 20 and inner tube 22. The adjustable clip 52 likewise provides for an adjustment of the height of the septum 50 which in turn regulates the amount of solution that will be discharged with each flush of the toilet. In dispenser 40, the float valve 54 replaces the float valve assembly 24. This design has the advantage of making the overall height of the dispenser shorter. The shorter overall height is advantageous in use for dispensers in a water saver toilet.

The operation of dispenser 100 is very similar to the operation of the previously described dispensers. However, the dispenser 100 does not have a standpipe or septum. The previously described standpipes or septums provide the advantage of allowing only a portion of the solution within the reservoir 12 to drain from the reservoir 12. In the operation of the dispenser 100, the raised intermediate bottom 101*g* effectively prevents the discharge of all of the solution within the reservoir 112. Only that solution that is above the intermediate bottom 101*g* will be discharged through the outlet 114.

It is understood that the amount of solution to be dispensed could also be controlled by having the inlet valve regulate the amount of water entering the reservoir. The inlet valve could be constructed to close, and thereby seal off any incoming water, before the reservoir is completely filled. There would therefore be less to dispense.

Other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follows in the spirit and broad scope of the appended claims are included.

I claim:

1. A dispenser for use in a flush tank of a toilet, the tank having a first water level during quiescent periods and a second water level when the toilet is flushed, said dispenser comprising:

(a) a housing having a top and bottom, said housing defining a reservoir having an inlet proximate said top and an outlet positioned lower than said inlet, said reservoir holding a product to be dispensed, the product dissolving in water forming a solution;

(b) a first valve means for regulating flow of water from the flush tank into said reservoir through said inlet, said first valve means responsive to changes from the first water level to the second water level;

(c) a second valve means for regulating flow of solution out of said reservoir through said outlet, said second valve means responsive to changes from the first water level to the second water level, whereby when the water rises to its first water level, said second valve means is closed and water enters the reservoir through said inlet until said reservoir is filled causing said first valve means to close, said first and second valve means minimizing migration of the solution out of said reservoir, and when the water is at the second water level, said second valve means opens allowing the solution to flow out of said outlet.

2. The dispenser of claim 1, further comprising an air vent having a first end in fluid communication with said reservoir and a second open end that extends above the first water level.

3. The dispenser of claim 2, wherein said top has a first end and a second end, said air vent being proximate said first end and said first end being relatively higher than said second end.

4. The dispenser of claim 1, wherein said first valve means comprises a hinged flap valve.

5. The dispenser of claim 4, wherein said flap valve comprises a float portion made from a closed cell foam material.

6. The dispenser of claim 1, wherein said second valve means comprises a hinged flap valve.

7. The dispenser of claim 1, wherein said outlet is positioned above said bottom, whereby only a portion of the solution in said reservoir flows out of said outlet when the toilet is flushed.

8. A dispenser for use in a flush tank of a toilet, the tank having a first water level during quiescent periods and a second water level when the toilet is flushed, said dispenser comprising:

(a) a housing having a top and bottom, said housing defining a reservoir having an inlet proximate said top and an outlet positioned lower than said inlet, said reservoir for holding a product to be dispensed, the product dissolving in water forming a solution;

(b) a first valve means for regulating flow of water from the flush tank into said reservoir through said inlet, said first valve means responsive to changes from the second water level to the first water level;

(c) a second valve means for regulating flow of solution out of said reservoir through said outlet, said second valve means responsive to changes from the first water level to the second water level; and (d) an upwardly extending wall means cooperatively connected to said housing, said wall means defining a cavity having an open top end and open bottom, said open bottom of said wall means positioned over said outlet and said open top being in fluid communication with said reservoir, whereby when the water rises to its first water level, said second valve means is closed and water enters the reservoir through said inlet until said reservoir is filled causing said first valve means to close, said first and second valve means minimizing migration of the solution out of said reservoir, and when the water is at the second water level, said second valve means opens allowing the solution to flow out of said outlet, whereby only the solution in said cavity and in said reservoir that is above the fluid communication with said cavity flow out of said outlet.

9. The dispenser of claim 8, wherein said wall means comprises a standpipe.

10. The dispenser of claim 9, wherein said standpipe has an adjustable height.

11. The dispenser of claim 8, wherein said housing comprises a plurality of sidewalls cooperatively connected to said top and said bottom and said wall means comprises a septum cooperatively connected to said sidewalls.

12. The dispenser of claim 11, wherein said septum has an adjustable height.

13. The dispenser of claim 8, wherein said housing defines a generally triangular prismatic shaped housing, whereby said housing will fit into a corner of the toilet tank.

14. The dispenser of claim 8, wherein said second valve means is recessed, whereby when said second valve means is in an open position, said second valve means does not extend below said bottom of said housing.

15. A dispenser for use in a flush tank of a toilet, the tank having a first water level during quiescent periods at second water level when the toilet is flushed, said dispenser comprising:

(a) a housing having a top and bottom, said housing defining a reservoir having an inlet in said top and an outlet in said bottom, said reservoir for holding a product to be dispensed, the product dissolving in water forming a solution;

(b) a first valve means for regulating flow of water from the flush tank into said reservoir through said inlet, said first valve means operative between a first and second position responsive to changes in water level;

(c) a second valve means for regulating flow of solution out of said reservoir through said outlet, said second valve means having an open and close position and responsive to changes in water level; and (d) an upwardly extending wall means cooperatively connected to said housing, said wall means defining a cavity having an open top end and an open bottom, said open bottom of said wall means positioned over said outlet and said open top being in fluid communication with said reservoir, said wall means having an adjustable height, whereby when the water rises to its first level, said second valve means is closed and said first valve means is open and water enters the reservoir through said inlet until said reservoir is filled causing said first valve means to close, said first and second valve means preventing migration of solution out of the reservoir during quiescent periods, and when the water is at a second water level, said second valve means opens allowing the solution to flow out of said outlet, whereby only the solution in said cavity and in said reservoir that is above the fluid communication with said cavity flow out of said outlet.

* * * * *